US010022749B2

(12) United States Patent
Ishizaka et al.

(10) Patent No.: US 10,022,749 B2
(45) Date of Patent: Jul. 17, 2018

(54) METHOD OF FORMING LAYERED COATING FILM

(71) Applicant: Fuji Jukogyo Kabushiki Kaisha, Tokyo (JP)

(72) Inventors: Junichi Ishizaka, Tokyo (JP); Takeshi Nakamura, Tokyo (JP); Tsuneo Tsukakoshi, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 181 days.

(21) Appl. No.: 15/065,692

(22) Filed: Mar. 9, 2016

(65) Prior Publication Data

US 2016/0288165 A1 Oct. 6, 2016

(30) Foreign Application Priority Data

Mar. 31, 2015 (JP) ..... 2015-071206

(51) Int. Cl.
*C25D 9/02* (2006.01)
*C25D 13/06* (2006.01)
(Continued)

(52) U.S. Cl.
CPC ..... *B05D 7/57* (2013.01); *B05D 1/04* (2013.01); *B05D 7/14* (2013.01); *B05D 7/577* (2013.01);
(Continued)

(58) Field of Classification Search
CPC ..... C25D 9/02; C25D 5/48
See application file for complete search history.

(56) References Cited

U.S. PATENT DOCUMENTS 5,945,218 A * 8/1999 Nakao ..... B05D 5/066 427/407.1
2002/0043464 A1* 4/2002 Miyatake ..... B05D 7/577 204/488
(Continued)

FOREIGN PATENT DOCUMENTS

JP 2000-070850 A 3/2000
JP 2013-060577 A 4/2013
(Continued)

OTHER PUBLICATIONS

Japanese Office Action in Japanese Application No. 2015-071206 dated Oct. 4, 2016 with an English translation thereof.

*Primary Examiner* — Brian W Cohen
(74) *Attorney, Agent, or Firm* — McGinn IP Law Group, PLLC

(57) ABSTRACT

A method of forming a layered coating film includes: coating a workpiece with an electrodeposition coating material to form an electrodeposition coating layer; applying a colored coating material including a white pigment over the electrodeposition coating layer to form two or more colored coating layers that are layered on the electrodeposition layer; and applying a clear coating material over the two or more colored coating layers. The colored coating material includes coating materials respectively applied to form a lower-side colored coating layer and an upper-side colored coating layer of the two or more colored coating layers. A concentration of the white pigment in the coating material applied to form the lower-side colored coating layer is equal to or higher than a concentration of the white pigment included in the coating material applied to form the upper-side colored coating layer.

15 Claims, 6 Drawing Sheets

(51) Int. Cl.

| | |
|---|---|
| ***C25D 5/48*** | (2006.01) |
| ***B05D 7/00*** | (2006.01) |
| ***B05D 7/14*** | (2006.01) |
| ***B05D 1/04*** | (2006.01) |
| ***C25D 13/16*** | (2006.01) |

(52) U.S. Cl.
CPC ..... *C25D 5/48* (2013.01); *C25D 9/02* (2013.01); *C25D 13/16* (2013.01); *B05D 2202/10* (2013.01); *B05D 2601/02* (2013.01)

(56) References Cited

U.S. PATENT DOCUMENTS

| | | | |
|---|---|---|---|
| 2011/0195262 | A1 | 8/2011 | Adachi |
| 2012/0021228 | A1 | 1/2012 | Kitagawa et al. |
| 2014/0030528 | A1 | 1/2014 | Kitagawa et al. |

FOREIGN PATENT DOCUMENTS

| | | | |
|---|---|---|---|
| WO | WO 2010/047352 | A1 | 4/2010 |
| WO | WO 2010/082607 | A1 | 7/2010 |
| WO | WO 2011/125490 | A1 | 10/2011 |
| WO | WO 2012/137884 | A1 | 10/2012 |
| WO | WO 2013/027093 | A1 | 2/2013 |

* cited by examiner

METHOD OF FORMING LAYERED COATING FILM

CROSS-REFERENCE TO RELATED APPLICATIONS

The present application claims priority from Japanese Patent Application No. 2015-071206 filed on Mar. 31, 2015, the entire contents of which are hereby incorporated by reference.

BACKGROUND

The technology relates to a method of forming a layered coating film. In particular, the technology relates to a method of forming a layered coating film by means of intercoat-less coating in coating of a vehicle such as, but not limited to, an automobile.

In coating of a vehicle body such as, but not limited to, an automobile body, a layered coating film has been formed that may include an electrodeposition coating layer, an intercoat layer, a topcoat layer, and a clear layer. The electrodeposition layer may have corrosion resistance. The intercoat layer may have light beam blocking properties, and the topcoat layer may have design properties. The clear layer may be provided for surface protection. These layers may be sequentially layered on a steel sheet that may serve as a workpiece.

Recently, a method (so-called intercoat-less coating) has been adopted in which the intercoat layer is eliminated from the layered coating film as mentioned above, and the topcoat layer is formed directly on the electrodeposition coating layer. This method eliminates one layer from the layers of the existing layered coating film, resulting in a shortened coating procedure as well as elimination of a coating material used for the intercoat layer. This method is therefore significantly advantageous in terms of productivity and costs. Also, elimination of the intercoat layer contributes to weight reduction of a vehicle body, and advantageously leads to enhanced fuel consumption performance and $CO_2$ reduction.

On the other hand, since the intercoat-less coating provides little light beam blocking that ought to be performed by the intercoat layer, light beams may pass through to reach the electrodeposition coating layer. This may cause deterioration in weather resistance of the electrodeposition coating layer, resulting in possibility of exfoliation at an interface between the electrodeposition coating layer and the topcoat layer.

In the intercoat-less coating, it is therefore desirable to impart the topcoat layer with the light beam blocking properties that have been originally imparted to the intercoat layer. Accordingly, in general, an ultraviolet absorber may be added to the topcoat layer. With regard to a wavelength region (300 nm to 420 nm both inclusive) that involves difficulties in light beam blocking by the ultraviolet absorber, possible measures may be to add a dark and deep colored pigment, e.g., carbon black, or to increase a film thickness of the topcoat layer.

However, the addition of the dark and deep colored pigment or the increase in the film thickness may cause concerns such as darkness of an appearance of the layered coating film and lowered design properties.

Japanese Unexamined Patent Application Publication (JP-A) No. 2000-70850 discloses a technique to cope with such lowered design properties. Specifically, an electrodeposition coating layer, a solid color layer, and a clear layer are sequentially formed on a steel sheet. The solid color layer includes fine particles of zinc oxide as an ultraviolet absorber. The fine particles of zinc oxide absorb light beams in wavelength regions of not only 300 nm to 360 nm both inclusive but also 360 nm to 420 nm both inclusive. This allows for elimination of the addition of the dark and deep colored pigment, e.g., carbon black, or elimination of the increase in the film thickness, attaining improved design properties.

SUMMARY

The layered coating film of JP-A No. 2000-70850 includes only one topcoat layer. However, some layered coating films are provided with a plurality of topcoat layers. The inventor(s) conducted an addition test of a white pigment with regard to such a layered coating film provided with the plurality of topcoat layers. The inventor(s) found that, compared to a case with no white pigment added to the topcoat layer, the addition of the white pigment to the topcoat layer may sometimes result in lowering of brightness and vividness in color of the layered coating film.

It is desirable to provide a method of forming a layered coating film that makes it possible to exhibit a bright and vivid color by means of intercoat-less coating.

An aspect of the technology provides a method of forming a layered coating film, the method including: coating a workpiece with an electrodeposition coating material to form an electrodeposition coating layer; applying a colored coating material including a white pigment over the electrodeposition coating layer to form two or more colored coating layers that are layered on the electrodeposition layer; and applying a clear coating material over the two or more colored coating layers. The colored coating material includes a coating material applied to form a lower-side colored coating layer of the two or more colored coating layers and a coating material applied to form an upper-side colored coating layer of the two or more colored coating layers. A concentration of the white pigment in the coating material applied to form the lower-side colored coating layer is equal to or higher than a concentration of the white pigment in the coating material applied to form the upper-side colored coating layer.

In the method of forming the layered coating film, the white pigment may include zinc oxide.

In the method of forming the layered coating film, the colored coating material may further include a resin and a pigment. An amount of the white pigment added to the colored coating material may be equal to or larger than 2.5 mass % based on a total amount of the resin and the pigment.

In the method of forming the layered coating film, the two or more colored coating layers may include two colored coating layers that may be the lower-side colored coating layer and the upper-side colored coating layer. The white pigment may be included solely in the lower-side colored coating layer.

DETAILED DESCRIPTION

Figure 1:
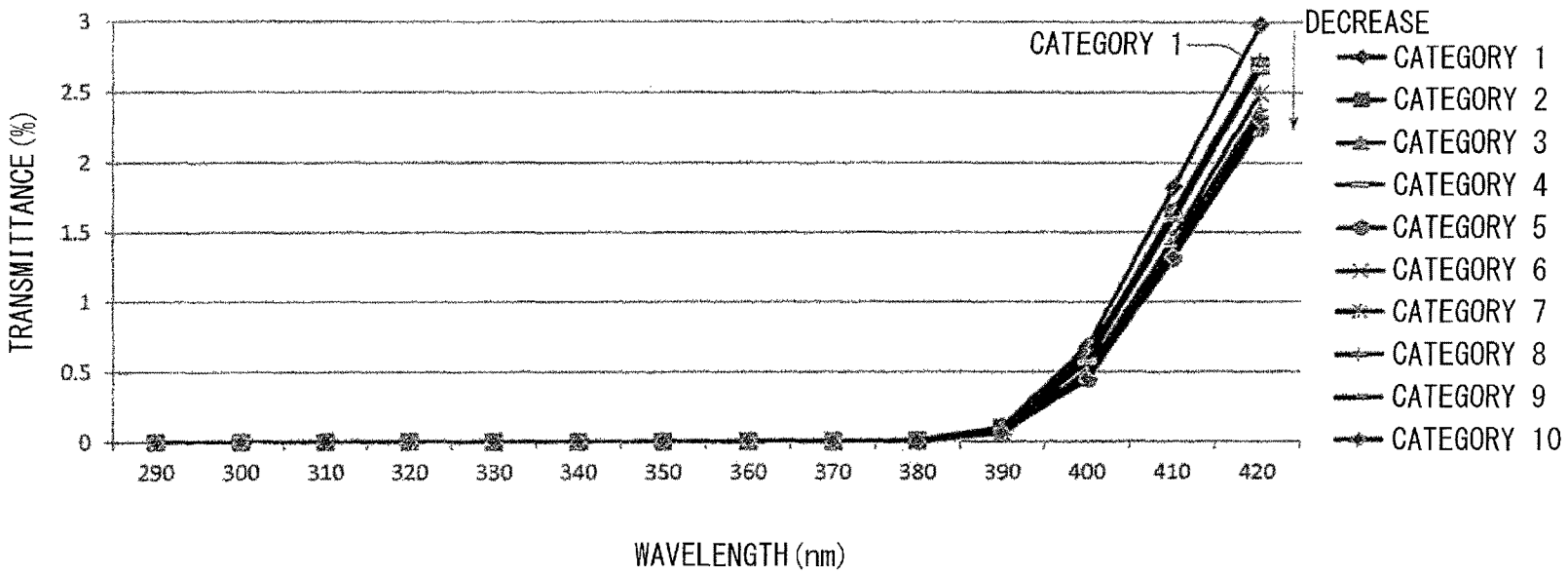
FIG. 1 is a diagram of light beam blocking effect obtained by addition of a white pigment to colored coating layers.
Figure 2:
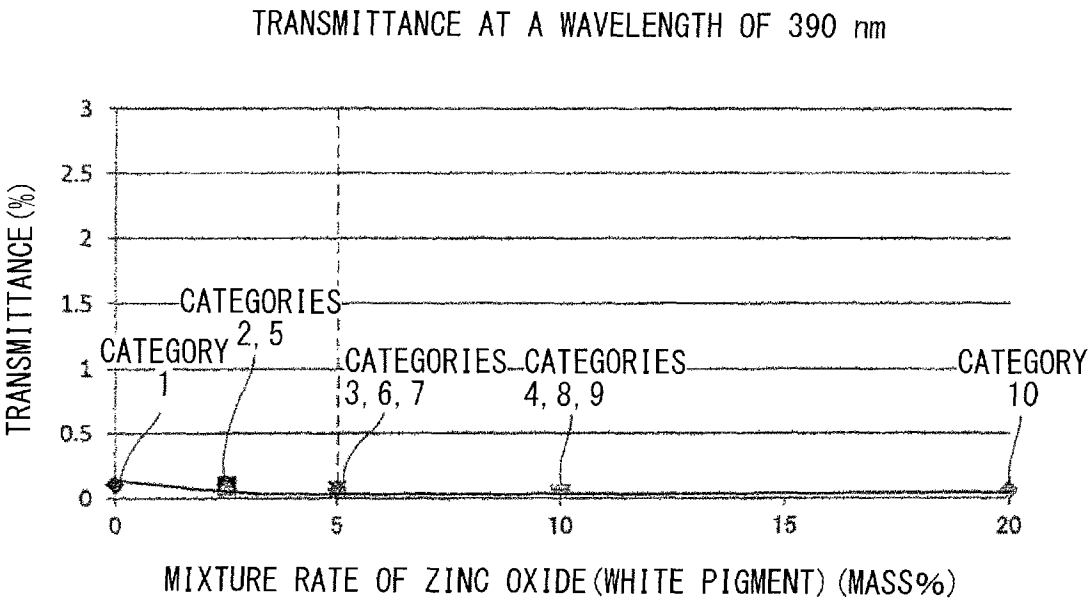
FIG. 2 is a diagram of transmittance in a wavelength region of 390 nm with regard to test sample categories 1 to 10 of a layered coating film.
Figure 3:
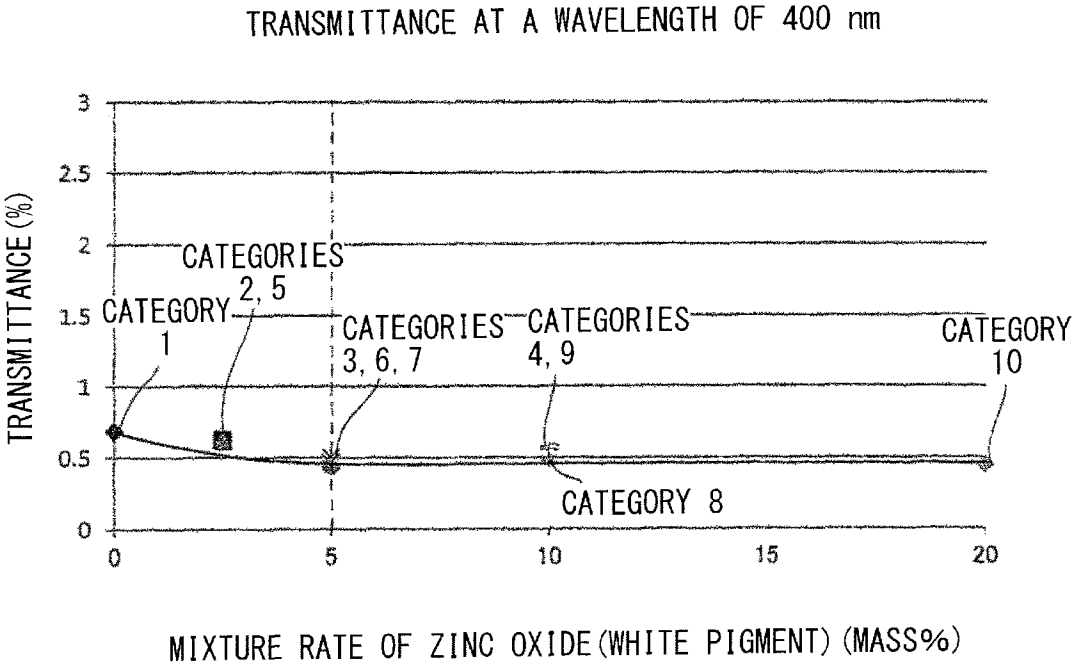
FIG. 3 is, likewise, a diagram of transmittance in a wavelength region of 400 nm.
Figure 4:
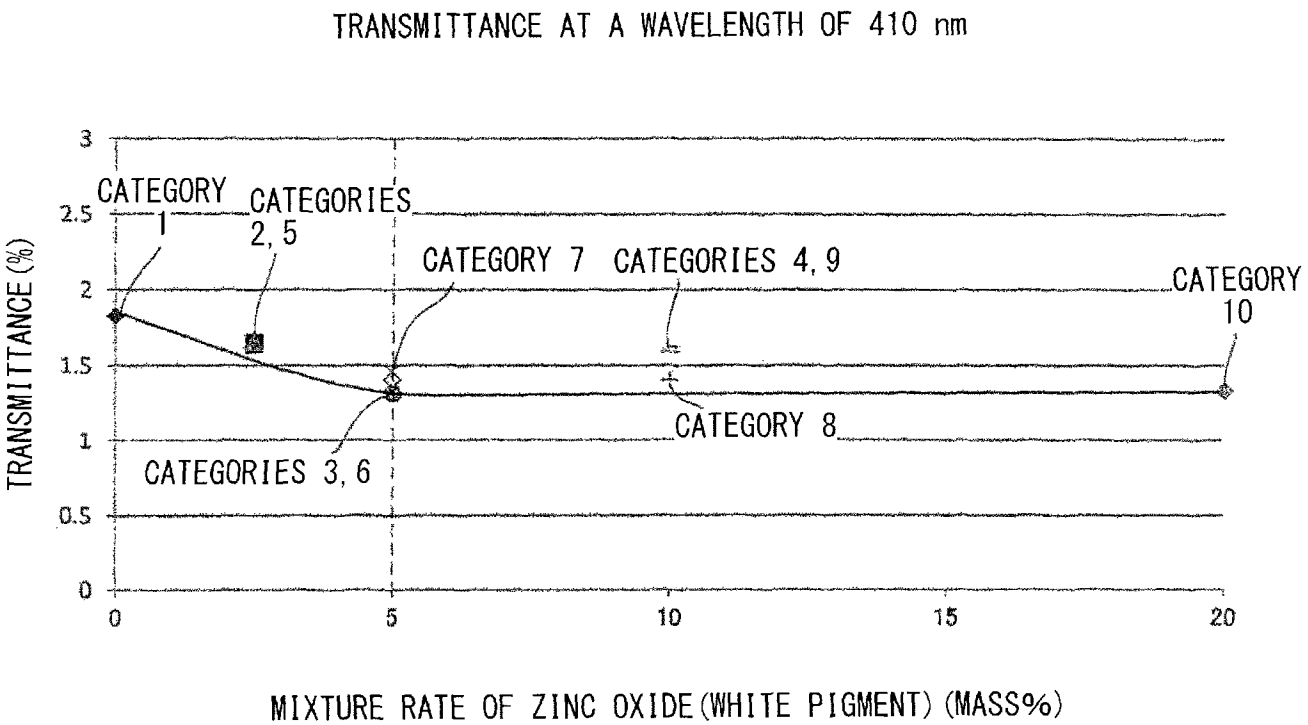
FIG. 4 is, likewise, a diagram of transmittance in a wavelength region of 410 nm.
Figure 5:
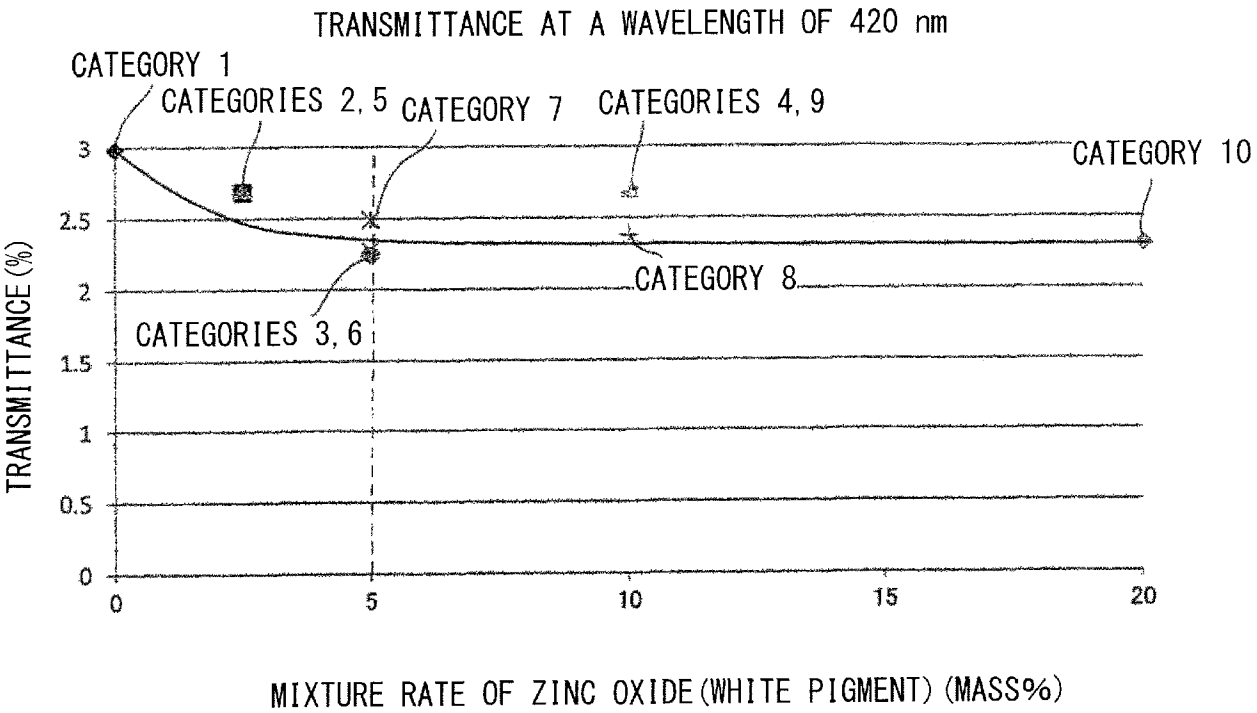
FIG. 5 is, likewise, a diagram of transmittance in a wavelength region of 420 nm.

A method of forming a layered coating film according to an implementation of the technology involves forming a layered coating film. Specifically, the method may involve sequentially forming, on a workpiece, an electrodeposition coating layer, two or more colored coating layers, and a clear layer. In the following, description is given of materials used for formation of each layer.

The workpiece may be any conductive sheet member that may serve as an electrode for electrodeposition coating. Preferably, such a sheet member may be subjected, in advance, to chemical conversion treatment in which a zinc phosphate coating is adhered to a surface of the plate member.

For an electrodeposition coating material used in coating of the electrodeposition coating layer, any coating material such as a cation electrodeposition coating material and an anion electrodeposition coating material may be used. Since a steel sheet may be generally used for the workpiece, a cation electrodeposition coating material may be preferably used in terms of imparting the steel sheet with corrosion resistance.

A cation electrodeposition coating material may be an aqueous solution or an aqueous dispersion including a cationic polymer salt and a crosslinking agent. The cationic polymer salt may be, for example, a base resin such as, but not limited to, an acrylic resin, and an epoxy resin modified with an amino compound or other compounds, to introduce a cationic group. This may be neutralized with an organic acid, an inorganic acid, or other acids to obtain the aqueous solution or the aqueous dispersion as mentioned above. As the crosslinking agent, a blocked polyisocyanate compound, an alicyclic epoxy resin, or other substances may be suitably used. Also, any additives such as, but not limited to, a pigment and a solvent may be added.

In an implementation of the technology, the two or more colored coating layers may include two colored coating layers that may be a first colored coating layer and a second colored coating layer. In one implementation of the technology, the first colored coating layer may serve as a "lower-side colored coating layer", and the second colored coating layer may serve as an "upper-side colored coating layer". The second colored coating layer may serve as a clear colored base having predetermined clarity. The first colored coating layer may serve as a colored base including a brilliant material as described later. With this configuration, reflection of transmitted light may contribute to enhancement in brightness, while attaining a color of high saturation as compared to a case with a single colored coating layer. A colored coating material may be used in coating of the two or more colored coating layers. The colored coating material may include a coating material (hereinafter referred to as a "first coating material") used in coating of the first colored coating layer, and a coating material (hereinafter referred to as a "second coating material") used in coating of the second colored coating layer. In one implementation of the technology, the first coating material may serve as a "coating material applied to form a lower-side colored coating layer of the two or more colored coating layers", and the second coating material may serve as a "coating material applied to form an upper-side colored coating layer of the two or more colored coating layers". The colored coating material may be a water-based thermosetting coating material, and may include a resin (including a crosslinking agent) as a main element of the coating film, a pigment, and an additive.

For the resin, any resin used for a water-based thermosetting coating resin may be used; non-limiting examples may include an acrylic resin, a polyester resin, an epoxy resin, a polyurethane resin, and a polyurethane-acrylic resin. For the crosslinking agent, a melamine resin, a blocked isocyanate, and other substances may be used.

For the pigment, an organic pigment, an inorganic pigment, or other pigments known as a water-based coating material may be used. As the pigment, besides a pigment for any desired coloration, a white pigment is added, allowing for a decrease in an amount of light beams passing through to reach the electrodeposition coating layer.

Non-limiting examples of the white pigment may include titanium oxide and zinc oxide. In terms of suppression of influences on a color derived from other pigments included in the colored coating layers, the white pigment may be zinc oxide, since zinc oxide has high clarity among white pigments.

The white pigment may be added to both the first coating material and the second coating material. When the white pigment is added to both the first coating material and the second coating material, a concentration of the white pigment added to the first coating material may be equal to or higher than a concentration of the white pigment added to the second coating material. Furthermore, the white pigment may be added solely to the first coating material; in other words, the white pigment may be included solely in the first colored coating layer.

The concentration of the white pigment added to the colored coating material may be any value that allows for the decrease in the amount of light beams passing through to reach the electrodeposition coating layer. An amount of the white pigment added to the colored coating material may be equal to or larger than 2.5 mass % based on a total amount of the resin and the pigment in the colored coating material. In particular, to add the white pigment at a rate of 2.5 mass % makes it possible to obtain the maximum light beam blocking effect while suppressing the amount of the white pigment added.

In a case with a difference in rates of the white pigment added to the first coating material and the second coating material, the concentration of the white pigment to a total amount of the colored coating material may be determined in terms of a ratio in film thickness of the first colored coating layer and the second colored coating layer obtained.

For example, in a case that the rate of the white pigment to the total amount of the resin and the pigment in the first coating material is 3 mass %, the rate of the white pigment to the total amount of the total amount of the resin and the pigment in the second coating material is 6 mass %, the thickness of the first colored coating layer obtained is 10 μm, and the thickness of the second colored coating layer obtained is 20 μm, the rate of the white pigment to the total amount of the resin and the pigment of the colored coating material is given as follows:

$$3\text{ mass }\%\times 10\ \mu\text{m}/30\ \mu\text{m}+6\text{ mass }\%\times 20\ \mu\text{m}/30\ \mu\text{m}=5\text{ mass }\%$$

Furthermore, the first coating material may further include a brilliant material as the pigment. Non-limiting examples of the brilliant material may include an aluminum pigment and an interference mica pigment.

Moreover, any other additive may be added to the first coating material and the second coating material. Non-limiting examples of the additive may include a plasticizer, a dispersant, a defoaming agent, an emulsifier, a thickening agent, a gas suppressing agent, a PH adjuster, and a surfactant.

The clear layer is adapted to impart glossiness and brilliance to the layered coating film, and to protect lower layers from acids, contamination, scratches, and other damages. A clear coating material used in coating of the clear layer may include a resin (including a crosslinking agent), a solvent, and optionally, an additive. The resin may be a thermosetting resin, and non-limiting examples may include an acrylic resin, a polyester resin, an alkyd resin, and an urethane resin. Non-limiting examples of the crosslinking agent may include a melamine resin, a urea resin, a polyisocyanate compound (including a blocked substance), a compound having a carboxyl group, and a compound having an epoxy group.

The solvent may be an organic solvent or water, and these may be used in combination. As the additive, a colored pigment may be further added.

Description is given next of a method of forming the layered coating film with use of the materials for the formation of each layer as described.

[Electrodeposition Coating Process]

A workpiece may be subjected to cation electrodeposition coating. The workpiece may be immersed in an electrodeposition tank filled with the electrodeposition coating material as described. Flowing a current with the workpiece serving as a cathode, and with an anode plate in the electrodeposition tank serving as an anode, may allow a coating to be deposited on the workpiece. The coating thus deposited may be subjected to bake drying treatment that may involve heating at 140° C. to 200° C. both inclusive for 1040 minutes. Thus, the electrodeposition coating layer may be obtained. A thickness of the electrodeposition coating layer may be, for example, 10 μm to 30 μm both inclusive.

[Application Process of Colored Coating Material]

The first coating material may be applied over the electrodeposition coating layer. As an application method, various application methods may be used; non-limiting examples may include brush coating, roller coating, spray coating, coating with use of a roll coater, and dip coating. Preferred but non-limiting application method may be spray coating and electrostatic coating. After application of the first coating material, appropriate setting time may be taken, following which the second coating material may be further applied. Note that, after each application of the coating material, treatment (i.e., baking treatment) of curing the coating material through heating may be carried out. Heating conditions may be, for example, at 100° C. to 170° C. both inclusive for 10 minutes to 40 minutes both inclusive. Alternatively, the coating materials used in this process may be cured through heating treatment after a clear coating process as described below, instead of carrying out the treatment (i.e., baking treatment) of curing the coating materials in this process. When the treatment of curing the coating materials is not carried out in this process, preliminary drying may be carried out prior to application of the clear coating material. Conditions of the preliminary drying may be, for example, at 80° C. for 3 minutes.

A thickness of each of the first colored coating layer and the second colored coating layer thus obtained may be, for example, 5 μm to 15 μm both inclusive.

[Clear Coating Process]

The clear coating material may be applied over the second colored coating layer. An application method may be selected from similar application methods to those of the first coating material and the second coating material as described. After application of the clear coating material, a coating thus obtained may be subjected to curing treatment (baking treatment) that may involve heating at 100° C. to 170° C. both inclusive for 10 minutes to 40 minutes both inclusive. A thickness of the clear layer thus obtained may range, for example, from 20 μm to 50 μm both inclusive.

Through the processes described above, the layered coating film according to the implementation of the technology may be formed.

As described, in the implementation, the first coating material and the second coating material may be sequentially applied over the electrodeposition coating layer to form the first colored coating layer and the second colored coating layer as the two or more colored coating layers. The concentration of the white pigment included in the first coating material may be equal to or higher than the concentration of the white pigment included in the second coating material. Hence, it is possible to reduce the amount of light beams passing through to reach the electrodeposition coating layer. It is also possible to enhance brightness of the layered coating film without impairing vividness even when the white pigment added to the two or more colored coating layers, as compared to a case with no white pigment added.

Moreover, in the implementation, the use of zinc oxide, which has high clarity among white pigments, allows for suppression of influences on a color derived from other pigments included in the colored coating layers. Hence, it is possible to form the layered coating film that exhibits more vivid color.

Furthermore, in the implementation, the amount of the white pigment added to the colored coating material may be equal to or larger than 2.5 mass % based on the total amount of the resin and the pigment in the colored coating material. This makes it possible to obtain sufficient light beam blocking effect. With this configuration, it is therefore possible to allow the white pigment to exhibit sufficient light beam blocking effect, while attaining good brightness and vividness in color of the layered coating film.

In addition, in the implementation, the two or more colored coating layers may include the two colored coating layers that may be the first colored coating layer and the second colored coating layer. The white pigment may be included solely in the first colored coating layer. With this configuration, it is possible to impart more enhanced brightness and vividness to the layered coating film, compared to the case with no white pigment added to the two or more colored coating layers.

EXAMPLES

Next, description is made in further detail by giving Examples and Comparative Examples of an implementation of the technology. Note that the Examples described hereinbelow are illustrative, and not to be construed as limiting to the technology.

<1. Samples>

The following is description of samples used for the formation of the layered coating film.

1-1. Workpiece

As the workpiece, used was a hot-dip galvanized steel sheet (having dimensions of 100 mm in length by 200 mm in width and a thickness of 0.7 mm) subjected to chemical conversion treatment in which a zinc phosphate coating was adhered to a surface of a sheet member.

1-2. Electrodeposition Coating Material

As the electrodeposition coating material, used was a cation electrodeposition coating material "SUCCED S#30S" ("SUCCED S" is a registered trademark of Axalta Shinto Coating Systems Co., Ltd) available from Axalta Shinto Coating Systems Co., Ltd. Located in Tokyo, Japan.

1-3. Colored Coating Material

In the Example, as the two or more colored coating layers, formed were the first colored coating layer and the second colored coating layer. The first colored coating layer was formed on the electrodeposition coating layer. The second colored coating layer was formed on the first colored coating layer. The coating material for each coating layer was as follows.

1-3-1. First Coating Material 15.0 parts by mass (solid content) of a water soluble acrylic resin (having a hydroxyl value of 70 and a number average molecular weight of 7,000), 26.7 parts by mass (solid content) of an acrylic emulsion resin (having a hycroxyl value of 40 and a number average molecular weight of 20,000), 17.9 parts by mass (solid content) of a butylated melamine resin, 23.6 parts by mass (solid content) of a pigment, 2.1 parts by mass (solid content) of zinc oxide, and water were mixed and stirred for homogenization. The pigment contained 5.08 parts by mass of aluminum, 10.89 parts by mass of phthalocyanine, 0.72 parts by mass of dioxazine, 0.01 parts by mass of carbon black, and 6.90 parts by mass of barium sulphate. Thus, the first coating material A to be used for the first colored coating layer was obtained.

Note that the first coating material A included zinc oxide as the white pigment at the rate of 2.5 mass % to the total amount of the resin and the pigment of the first coating material A.

Moreover, 14.6 parts by mass (solid content) of the water soluble acrylic resin (having the hydroxyl value of 70 and the number average molecular weight of 7,000), 26.3 parts by mass (solid content) of the acrylic emulsion resin (having the hycroxyl value of 40 and the number average molecular weight of 20,000), 17.5 parts by mass (solid content) of the butylated melamine resin, 23.0 parts by mass (solid content) of the pigment, 4.3 parts by mass (solid content) of zinc oxide, and water were mixed and stirred for homogenization. The pigment contained 4.95 parts by mass of aluminum, 10.61 parts by mass of phthalocyanine, 0.71 parts by mass of dioxazine, 0.01 parts by mass of carbon black, and 6.72 parts by mass of barium sulphate. Thus, the first coating material B to be used for the first colored coating layer was obtained.

Note that the first coating material B included zinc oxide as the white pigment at the rate of 2.5 mass % to the total amount of the resin and the pigment of the first coating material B.

Furthermore, 14.0 parts by mass (solid content) of the water soluble acrylic resin (having the hydroxyl value of 70 and the number average molecular weight of 7,000), 25.1 parts by mass (solid content) of the acrylic emulsion resin (having the hycroxyl value of 40 and the number average molecular weight of 20,000), 16.7 parts by mass (solid content) of the butylated melamine resin, 22.0 parts by mass (solid content) of the pigment, 8.7 parts by mass (solid content) of zinc oxide, and water were mixed and stirred for homogenization. The pigment contained 4.74 parts by mass of aluminum, 10.15 parts by mass of phthalocyanine, 0.67 parts by mass of dioxazine, 0.01 parts by mass of carbon black, and 6.43 parts by mass of barium sulphate. Thus, the first coating material C to be used for the first colored coating layer was obtained.

Note that the first coating material C included zinc oxide as the white pigment at the rate of 10.0 mass % to the total amount of the resin and the pigment of the first coating material C.

Meanwhile, a coating material was prepared, as the first coating material Z, at a same prescribed dosage as that of the first coating material A, except for exclusion of zinc oxide.

The water was finally added to each of the first coating materials A, B, C, and Z as described. An amount of addition of the water was in a range from 150 parts by mass to 300 parts by mass both inclusive.

1-3-2. Second Coating Material 18.3 parts by mass (solid content) of the water soluble acrylic resin (having the hydroxyl value of 70 and the number average molecular weight of 7,000), 32.9 parts by mass (solid content) of the acrylic emulsion resin (having the hycroxyl value of 40 and the number average molecular weight of 20,000), 21.9 parts by mass (solid content) of the butylated melamine resin, 8.3 parts by mass (solid content) of a pigment, 2.1 parts by mass (solid content) of zinc oxide, and water were mixed and stirred for homogenization. The pigment contained 1.12 parts by mass of phthalocyanine, 0.01 parts by mass of dioxazine, 0.01 parts by mass of carbon black, and 7.16 parts by mass of barium sulphate. Thus, the second coating material A to be used for the second colored coating layer was obtained.

Note that the second coating material A included zinc oxide as the white pigment at the rate of 2.5 mass % to the total amount of the resin and the pigment of the second coating material A.

Moreover, 17.9 parts by mass (solid content) of the water soluble acrylic resin (having the hydroxyl value of 70 and the number average molecular weight of 7,000), 32.2 parts by mass (solid content) of the acrylic emulsion resin (having the hydroxyl value of 40 and the number average molecular weight of 20,000), 21.5 parts by mass (solid content) of the butylated melamine resin, 8.1 parts by mass (solid content) of the pigment, 4.2 parts by mass (solid content) of zinc oxide, and water were mixed and stirred for homogenization. The pigment contained 1.11 parts by mass of phthalocyanine, 0.01 parts by mass of dioxazine, 0.01 parts by mass of carbon black, and 6.97 parts by mass of barium sulphate. Thus, the second coating material B to be used for the second colored coating layer was obtained.

Note that the second coating material B included zinc oxide as the white pigment at the rate of 5.0 mass % to the total amount of the resin and the pigment of the second coating material B.

Furthermore, 17.1 parts by mass (solid content) of the water soluble acrylic resin (having the hydroxyl value of 70 and the number average molecular weight of 7,000), 30.8 parts by mass (solid content) of the acrylic emulsion resin (having the hydroxyl value of 40 and the number average molecular weight of 20,000), 20.5 parts by mass (solid content) of the butylated melamine resin, 7.7 parts by mass (solid content) of the pigment, 8.5 parts by mass (solid content) of zinc oxide, and water were mixed and stirred for homogenization. The pigment contained 1.04 parts by mass of phthalocyanine, 0.01 parts by mass of dioxazine, 0.01 parts by mass of carbon black, and 6.64 parts by mass of barium sulphate. Thus, the second coating material C to be used for the second colored coating layer was obtained.

Note that the second coating material C included zinc oxide as the white pigment at the rate of 10.0 mass % to the total amount of the resin and the pigment of the second coating material C.

Meanwhile, a coating material was prepared, as the second coating material Z, at a same prescribed dosage as that of the second coating material A, except for exclusion of zinc oxide.

The water was finally added to each of the second coating materials A, B, C, and Z as described. An amount of addition of the water was in a range from 150 parts by mass to 300 parts by mass both inclusive.

Table 1 summarizes the rates (mass %) of zinc oxide (i.e., the white pigment) to the total amount of the resin and the pigment of each colored coating material inclusive of the first coating material and the second coating material. Zinc oxide was added to the first coating material and the second coating material respectively provided for the first colored coating layer and the second colored coating layer in the layered coating film to be formed.

1-4. Clear Coating Material

As the clear coating material, used was a carboxylic acid/epoxy curable solvent type clear coating material available from NIPPONPAINT Co., Ltd. Located in Tokyo, Japan.

<2. Formation of Layered Coating Film>

Electrodeposition coating was carried out, by a routine procedure, over a hot-dip galvanized steel sheet as the workpiece, to allow a dried coating to be 15 μm thick. Baking was carried out through heating at 150° C. for 20 minutes. Next, electrostatic coating of the first coating material was carried out, with use of "Accubell 608" available from SAMES Technologies located in Meylan, France, over the electrodeposition coating layer thus obtained, to allow a dried coating to be 8 μm thick. After setting for 7 minutes, electrostatic coating of the second coating material was further carried out, with use of "Accubell 608" as mentioned above, over the first colored coating layer in an uncured state, to allow a dried coating to be 7 μm thick.

Thereafter, the preliminary drying was carried out at 80° C. for 3 minutes.

Next, electrostatic coating of the clear coating material was carried out, with use of a rotary atomization type electrostatic applicator often referred to as "μμ (micro micro) Bell" available from Ransburg Industrial Finishing K.K. located in Yokohama, Japan, to allow a thickness after drying to be 35 μm. Baking was carried out through heating at 140° C. for 20 minutes. Thus, the layered coating film was completed.

TABLE 1

| | | Test sample categories of the layered coating film to be formed | | | | | | | | | |
|---|---|---|---|---|---|---|---|---|---|---|---|
| | | 1 Comparative Example | 2 Example | 3 Example | 4 Example | 5 Comparative Example | 6 Example | 7 Comparative Example | 8 Example | 9 Comparative Example | 10 Example |
| Rate (mass %) of zinc oxide | First coating material A | | 2.5 | | | | 2.5 | | | | 10.0 |
| | First coating material B | | | 5.0 | | | | | 5.0 | | |
| | First coating material C | | | | 10.0 | | | | | | |
| | First coating material Z | 0.0 | | | | 0.0 | | 0.0 | | 0.0 | |
| | Second coating material A | | | | | 2.5 | 2.5 | | | | |
| | Second coating material B | | | | | | | 5.0 | 5.0 | | |
| | Second coating material C | | | | | | | | | 10.0 | 10.0 |
| | Second coating material Z | 0.0 | 0.0 | 0.0 | 0 | | | | | | |
| Rate (mass %) of zinc oxide (white pigment) to the total amount of the resin and the pigment in the colored coating material | | 0.0 | 1.33 | 2.67 | 5.33 | 1.17 | 2.5 | 2.33 | 5.0 | 4.67 | 10.0 |

<3. Measurement of Light Beam Blocking Effect Exhibited by Zinc Oxide>

A confirmation test of the light beam blocking effect was carried out on each of the layered coating films (test sample categories 1 to 10).

As evaluation of the light beam blocking effect, measurement of transmittance was carried out with use of an ultraviolet-visible-near-infrared spectrophotometer "SHIMADZU UV-3600" and an integrating sphere "ISR-3100", both available from Shimadzu Corporation located in Kyoto, Japan. The transmittance thus measured is shown in FIG. 1.

As shown in the figure, it was reconfirmed that the test sample categories (the categories 2 to 10) with the white pigment (zinc oxide) added exhibited the good light beam blocking effect even in the wavelength region (390 nm to 420 nm both inclusive) that involved difficulties in obtaining the light beam blocking effect with use of a normal ultraviolet absorber, as compared to the test sample category (the category 1) with no white pigment (zinc oxide) added.

FIGS. 2 to 5 are diagrams of transmittance in wavelength regions of, respectively, 390 nm (FIG. 2), 400 nm (FIG. 3), 410 nm (FIG. 4), and 420 nm (FIG. 5) with regard to the test sample categories 1 to 10. As shown in the figures, the result was as follows. Over all the wavelength regions from 390 nm to 420 nm both inclusive, the light beam blocking effect was roughly maximized where the rate of the white pigment (zinc oxide) to the total amount of the resin and the pigment of an entirety of the first coating material and the second coating material was equal to or higher than 2.5 mass %. To add the white pigment (zinc oxide) at an even higher rate caused no increase in the light beam blocking effect.

Accordingly, the conclusion was that the appropriate rate of addition of the white pigment (zinc oxide) was equal to or higher than 2.5 mass % to the total amount of the resin and the pigment of the colored coating material applied to form the colored coating layers.

<4. Confirmation of Influences on Luminosity and Chroma of Layered Coating Film by Addition (2.5 mass %) of White Pigment (Zinc Oxide)>

Measurement test of luminosity and chroma was carried out on the layered coating films of the test sample categories 1, 3, 6, and 7. The test sample category 1 was a category with no zinc oxide (the white pigment) added to the colored coating layers. The test sample categories 3, 6, and 7 were categories in which the rate of zinc oxide (the white pigment) to the total amount of the resin and the pigment of the colored coating material that constituted the colored coating layers was approximately 2.5 mass % (respectively, 2.67 mass %, 2.5 mass %, and 2.33 mass % in the order named).

Figure 6:
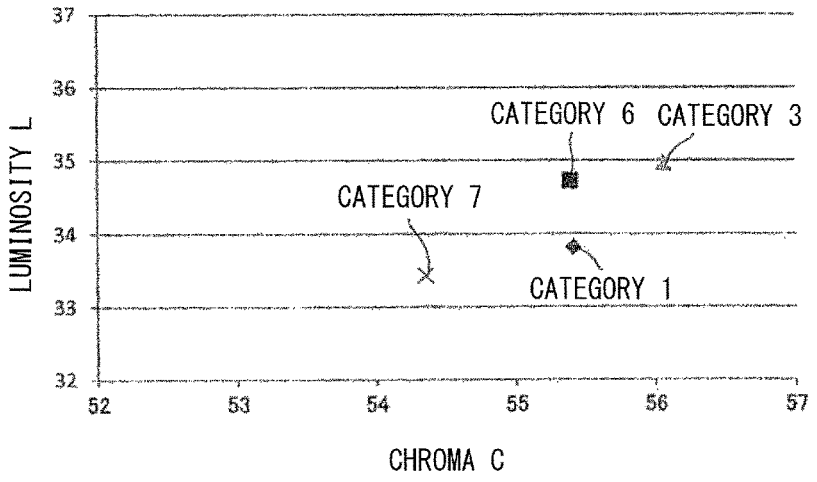
FIG. 6 is a diagram of influences on luminosity and chroma of the layered coating film by addition of zinc oxide (the white pigment) to the colored coating layers.

The measurement test of luminosity and chroma with regard to each test sample category was carried out by means of measurement based on L*C*h color system with use of a spectral colorimeter "CM-512m3" available from KONICA MINOLTA, Inc. located in Tokyo, Japan. FIG. 6 is a diagram of luminance L (along a vertical axis) and chroma C (along a horizontal axis) with respect to the layered coating films of the test sample categories 1, 3, 6, and 7.

As shown in the figure, in the test sample category 7 with zinc oxide added solely to the second colored coating layer, observed was a phenomenon of a decrease in both the luminosity L and the chroma C, as compared to the test sample category 1 with no zinc oxide added to the colored coating layers. Accordingly, it was found that to simply add zinc oxide (the white pigment) sometimes caused a decrease in brightness and vividness of the layered coating film, as compared to the layered coating film with no zinc oxide added.

Meanwhile, in the test sample category 6 with zinc oxide (the white pigment) added, at same rates, to both the first colored coating layer and the second colored coating layer, the chroma C was at a same level while the luminosity L was increased, as compared to the test sample category 1 with no zinc oxide added to the colored coating layers. Accordingly, it was found that addition of zinc oxide (the white pigment), at same rates, to both the upper-side coating layer and the lower-side colored coating layer made it possible to enhance brightness of the layered coating film without impairing vividness, as compared to the layered coating film with no zinc oxide added.

Furthermore, in the test sample category 3 with zinc oxide (the white pigment) added solely to the first colored coating layer, both the luminosity L and the chroma C were improved, as compared to the test sample category 1 with no zinc oxide added to the colored coating layers. Accordingly, it was found that addition of zinc oxide (the white pigment) solely to the lower-side colored coating layer made it possible to form the layered coating film with brightness and vividness, as compared to the layered coating film with no zinc oxide added.

Note that, for purpose of confirmation, description is given below of examination of the light beam blocking effect in the test sample categories 1, 3, 6, and 7 as described.

Figure 7:
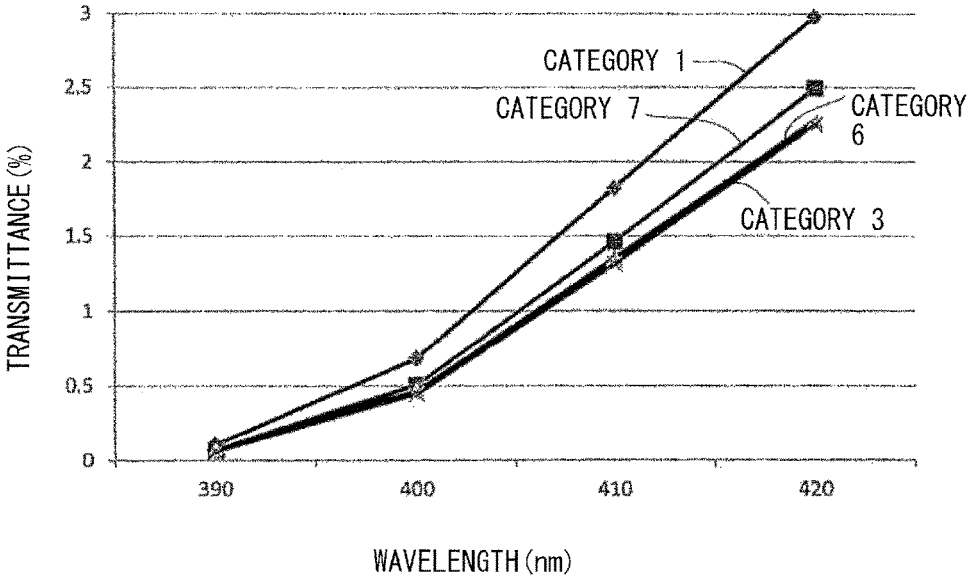
FIG. 7 is an enlarged diagram of a part of a wavelength region of 390 nm to 420 nm both inclusive in FIG. 1, with regard to the test sample categories 1, 3, 6, and 7.

FIG. 7 is an enlarged diagram of a part of the wavelength region of 390 nm to 420 nm both inclusive in the confirmation test of the light beam blocking effect exhibited by zinc oxide in FIG. 1. FIG. 7 is provided for purpose of confirmation of the light beam blocking effect concerning only the test sample categories 1, 3, 6, and 7. As indicated in the figure, it was confirmed that, as compared to the test sample category 1 with no zinc oxide added to the colored coating layers, all of the test sample categories 3, 6, and 7 with zinc oxide added exhibited the good light beam blocking effect.

As described above, according to the implementation, it is possible to not only reduce the amount of light beams passing through to reach the electrodeposition coating layer, but also enhance brightness and vividness of the layered coating film even when the white pigment is added to a topcoat layer, compared to a case with no white pigment added.

Hence, it is possible to develop a vehicle having an appearance with an even brighter and more vivid color tone by means of the intercoat-less coating.

The technology is by no means limited to the implementations described above, and may be modified in variety of ways without departing from the scope of the technology. In the forgoing implementations, the two or more colored coating layers may have a two-layer configuration that includes the first colored coating layer and the second colored coating layer. However, the two or more colored coating layers may have a configuration that includes three, four, or more colored coating layers.

As used herein, the term "sheet" may be used interchangeably with the term "plate".

Although some preferred implementations of the technology have been described in the foregoing by way of example with reference to the accompanying drawings, the technology is by no means limited to the implementations described above. It should be appreciated that modifications and alterations may be made by persons skilled in the art without departing from the scope as defined by the appended claims. The technology is intended to include such modifications and alterations in so far as they fall within the scope of the appended claims or the equivalents thereof.

The invention claimed is:

1. A method of forming a layered coating film, the method comprising:

coating a workpiece with an electrodeposition coating material to form an electrodeposition coating layer;

applying a colored coating material over the electrodeposition coating layer to form two or more colored coating layers that are layered on the electrodeposition layer, the applying of the colored coating material including:

applying a first coating material that includes a white pigment comprising zinc oxide, a brilliant pigment and a first coloration pigment to form a lower-side colored coating layer; and applying a second coating material that does not include a white pigment and includes a second coloration pigment, to form an upper-side colored coating layer onto a surface of the lower-side colored coating layer; and applying a clear coating material onto a surface of the upper-side colored coating layer, wherein the applying of the colored coating material further comprises:

after the applying of the first coating material, performing a first heat treatment to cure the first coating material; and after the applying of the second coating material, performing a second heat treatment to cure the second coating material.

2. The method of forming the layered coating film according to claim 1, wherein the colored coating material further includes a resin and a pigment, and an amount of the white pigment added to the colored coating material is equal to or larger than 2.5 mass % based on a total amount of the resin and the pigment.

3. The method of forming the layered coating film according to claim 1, wherein the two or more colored coating layers comprise two colored coating layers that are the lower-side colored coating layer and the upper-side colored coating layer.

4. The method of forming the layered coating film according to claim 2, wherein the two or more colored coating layers comprise two colored coating layers that are the lower-side colored coating layer and the upper-side colored coating layer.

5. The method of forming the layered coating film according to claim 1, wherein the applying of the colored coating material further includes:

mixing and stirring the white pigment with a resin and a pigment to form the first coating material.

6. The method of forming the layered coating film according to claim 5, wherein the applying of the colored coating material further includes:

after the mixing and stirring of the white pigment with the resin and the pigment, adding water to the first coating material in an amount ranging from 150 parts by mass to 300 parts by mass.

7. The method of forming the layered coating film according to claim 1, wherein the first and second heat treatments comprise heating the coating material in a range from 100° C. to 170° C. for a duration in a range from 10 minutes to 40 minutes.

8. The method of forming the layered coating film according to claim 1, wherein a thickness of each of the lower-side colored coating layer and the upper-side colored coating layer is in a range from 5 μm to 15 μm.

9. The method of forming the layered coating film according to claim 1, wherein the brilliant pigment comprises at least one of an aluminum pigment and an interference mica pigment.

10. The method of forming the layered coating film according to claim 1, wherein the brilliant pigment comprises at least one of an aluminum pigment and an interference mica pigment, the first coloration pigment comprises at least one of a phthalocyanine pigment and a dioxazine pigment, and the second coloration pigment comprises at least one of a phthalocyanine pigment and a dioxazine pigment.

11. The method of forming the layered coating film according to claim 2, wherein the resin comprises a water-based thermosetting coating resin including one of an acrylic resin, a polyester resin, an epoxy resin, a polyurethane resin, and a polyurethane-acrylic resin.

12. The method of forming the layered coating film according to claim 11, wherein the resin comprises a cross-linking agent including one of a melamine resin, and a blocked isocyanate.

13. A method of forming a layered coating film, the method comprising:

coating a workpiece with an electrodeposition coating material to form an electrodeposition coating layer;

applying a first coating material to form a lower-side colored coating layer on a surface of the electrodeposition coating layer;

applying a second coating material to form an upper-side colored coating layer on a surface of the lower-side colored coating layer; and applying a clear coating material onto a surface of the upper-side colored coating layer, wherein the first coating material includes a first composite pigment that consists of, by mass ratio of solid content, 4.74 to 5.08 of aluminum pigment, 2.1 to 8.7 of zinc oxide, 10.15 to 10.89 of phthalocyanine pigment, 0.67 to 0.72 of dioxazine pigment, 0.01 of carbon black and 6.43 to 6.72 of barium sulphate, and wherein the second coating material includes a second composite pigment that consists of, by mass ratio of solid content, 0 to 8.5 of zinc oxide, 1.04 to 1.12 of phthalocyanine pigment, 0.01 of dioxazine pigment, 0.01 of carbon black and 6.64 to 7.16 of barium sulphate.

14. The method of forming the layered coating film according to claim 1, wherein in the applying of the first coating material, the first coating material is applied onto a surface of the electrodeposition coating layer.

15. A method of forming a layered coating film, the method comprising:

coating a workpiece with an electrodeposition coating material to form an electrodeposition coating layer;

forming a first colored coating layer, comprising:

mixing and stirring white pigment comprising zinc oxide with a resin and a pigment to form a first coating material;

applying the first coating material onto the coated workpiece; and performing a heat treatment of the first coating material;

forming a second colored coating layer, comprising:

mixing and stirring a resin and a pigment to form a second coating material, the second coating material not including a white pigment;

applying the second coating material onto the first colored coating layer; and performing a heat treatment of the second coating material; and applying a clear coating material onto the second colored coating layer, wherein an amount of the white pigment in the first coating material is equal to or greater than 2.5 mass % based on a total amount of the resin and the pigment in the first and second coating materials.

* * * * *